United States Patent [19]

Pottier et al.

[11] Patent Number: 4,767,349

[45] Date of Patent: Aug. 30, 1988

[54] WET ELECTRICAL CONNECTOR

[75] Inventors: Alain P. Pottier; James J. Walulik, both of Houston; Ralph L. Simmons, Pearland, all of Tex.

[73] Assignee: Schlumberger Technology Corporation, Houston, Tex.

[21] Appl. No.: 935,143

[22] Filed: Nov. 25, 1986

Related U.S. Application Data

[63] Continuation of Ser. No. 565,795, Dec. 27, 1983, abandoned.

[51] Int. Cl.[4] ..... H01R 4/60

[52] U.S. Cl. ..... 439/191; 166/65.1; 439/271

[58] Field of Search ..... 339/94 R, 94 M, 8 L, 339/5 L, 117 R, 118 R, 117 P, 42, 94 C, 115 R; 166/65 R, 65 M, 66; 439/41, 190, 191, 271

[56] References Cited

U.S. PATENT DOCUMENTS

| | | | |
|---|---|---|---|
| 1,901,004 | 3/1933 | Peroni et al. | 334/42 |
| 3,508,188 | 4/1970 | Buck | 339/94 C |
| 3,641,479 | 2/1972 | O'Brien et al. | 339/94 R |
| 3,989,330 | 11/1976 | Cullen et al. | 339/94 R |
| 4,174,875 | 11/1979 | Wilson et al. | 339/117 P |
| 4,188,084 | 2/1980 | Buresi et al. | 339/117 R |
| 4,390,229 | 6/1983 | Chevalier | 339/117 P |

*Primary Examiner*—Eugene F. Desmond
*Attorney, Agent, or Firm*—Henry N. Garrana

[57] ABSTRACT

Connector assembly for use in a fluid medium comprising a male connector with a cylindrical pin with several axially spaced contact elements, and a female connector with a tubular housing and axially spaced annular contacts secured inside the housing. Seals with a flexible central portion are alternated with the contacts and with the latter define a bore to accommodate the pin. A chamber filled with dielectric liquid is defined within the housing as a rear extension of the bore, the entry of which is closed to external fluid by a sealing member. A free space is left around the flexible portion of each tubular seal, and each of said spaces communicates with the aforementioned chamber. Means are provided by which the pressure increases in the chamber when the pin is inserted. The pressure rise in the spaces around the seals increases the pressure force of the seals against the pin.

11 Claims, 4 Drawing Sheets

Figure 2A:
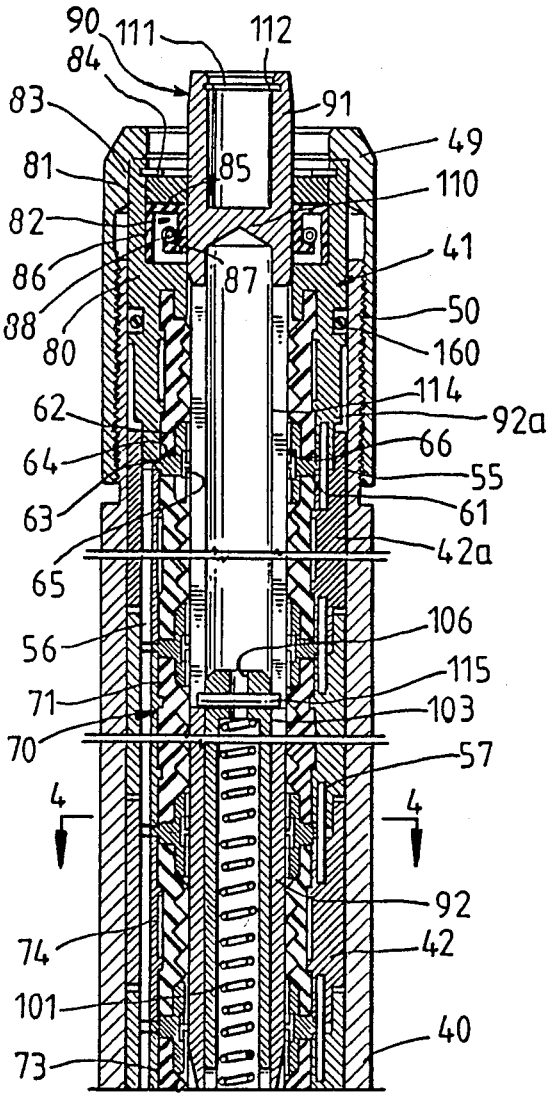
Figure 2A:
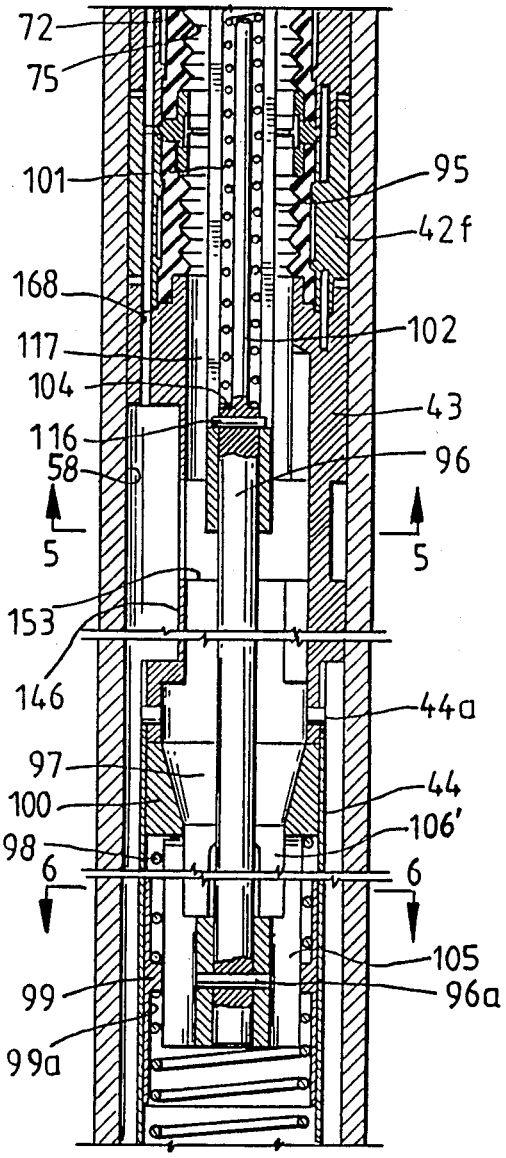

Fig. 1
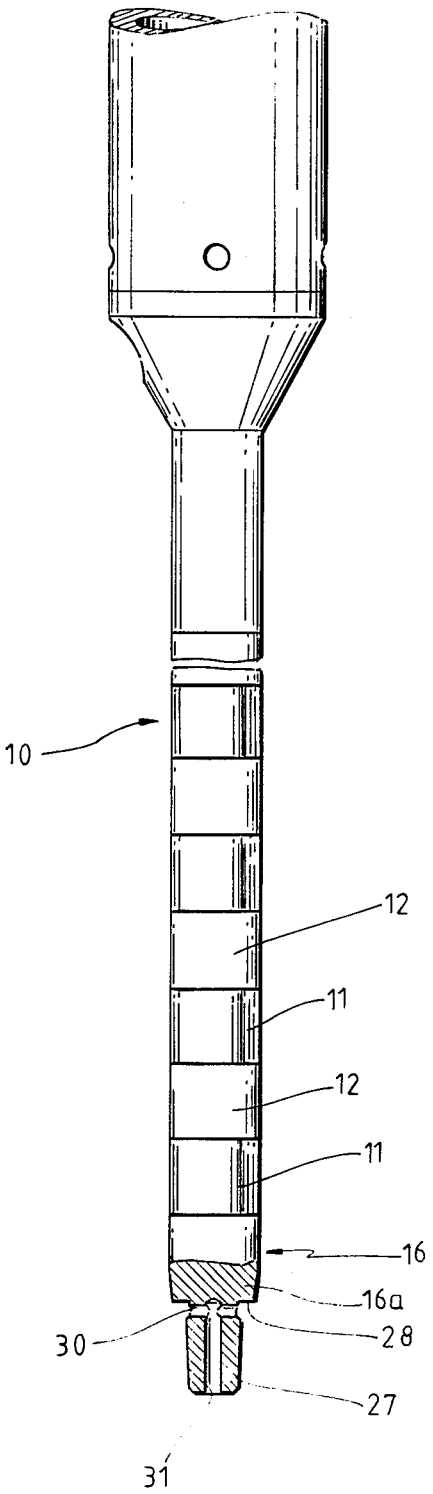
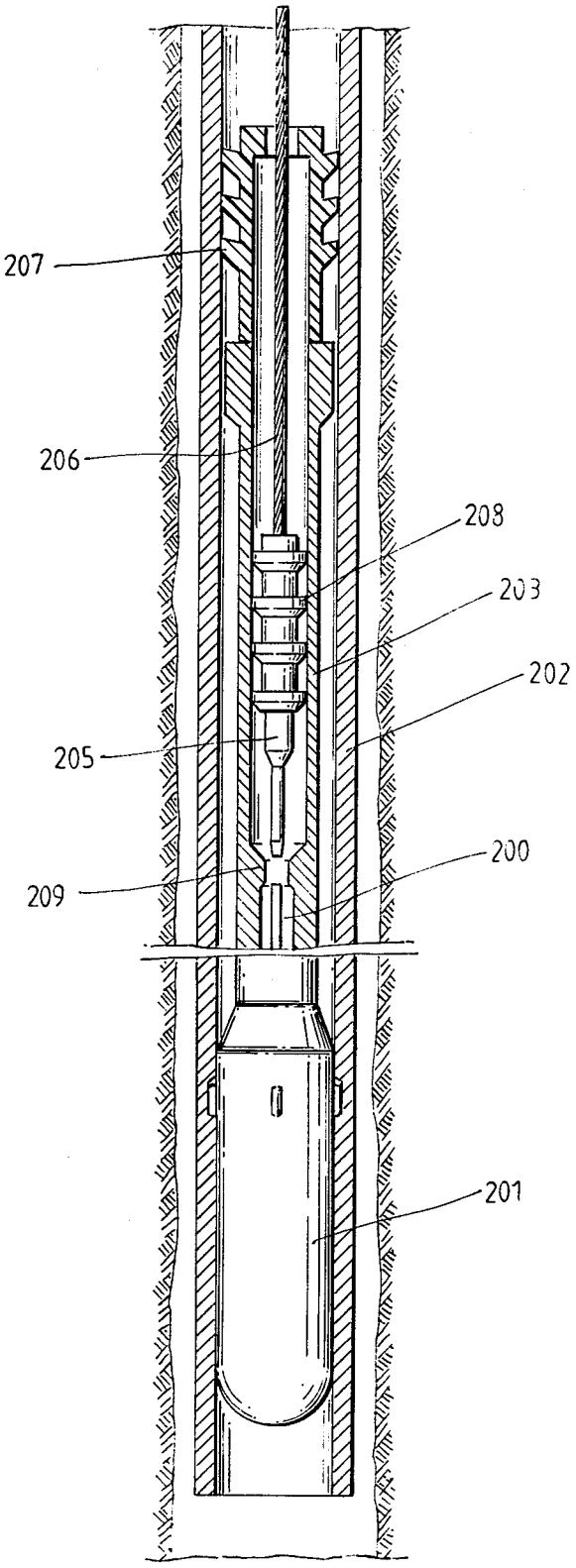
Fig. 8

WET ELECTRICAL CONNECTOR

This is a continuation of application Ser. No. 565,795, filed 12-27-83, now abandoned.

This invention concerns an electrical connector assembly for effecting repeated connections between groups of electrical contacts in a fluid medium, and comprising a male connector and a female connector each having a group of contacts.

A connector assembly of this type is necessary for instance in deviated hole logging techniques based on U.S. Pat. No. 4,349,072, and copending patent application No. 460,340, filed on Jan. 24, 1983, now U.S. Pat. No. 4,485,870 in view of establishing the electrical connection between a logging tool placed at the end of a drill string and a transmission cable connected to a surface unit.

U.S. Pat. No. 3,641,479 describes an underwater connector assembly, the female portion of which has several axially spaced annular contacts. The insulation between the pairs of adjacent contacts when the male connector is inserted, as well as the seal from external fluid is accomplished by O-rings disposed in alternate arrangement with the contacts in the female connector. These O-rings are radially compressed by the insertion of the male connector.

Another knowm method uses generally tubular seals occupying the intervals between the adjacent contacts, instead of O-rings. Each seal has an inside diameter smaller than the outside diameter of the contacts of the male connector, and is thus compressed when the male connector is inserted. The central portion of the seals is surrounded by an annular space communicating with the outside fluid.

The known devices are, however, not completely efficient. It may happen that the fluid present on the pin of the male connector before its insertion is not completely wiped off and that a fluid film remains on part of the pin. The external fluid, e.g. drilling mud in the case of a well, is generally electrically conductive, and faulty insulation can result from the continued presence of a fluid film on the pin when the connection is made.

A primary object of the invention is a multi-contact connector assembly in which the insulation between adjacent contacts during connection is improved.

The invention provides for a connector assembly to make the connection in a fluid medium. The connector assembly comprises a male connector with a cylindrical pin extending along the longitudinal axis of the male connector and carrying several longitudinally-spaced contacts; and a female connector with a tubular housing and and a corresponding number of similarly spaced annular contacts secured inside the housing. Tubular seals with a flexible central portion are alternated with the contacts and with the latter define a bore to accommodate the pin. A chamber filled with dielectric liquid is defined within the housing as a rear extension of the bore, the entry of which is closed to external fluid by a sealing member. A free space is left around the flexible portion of each tubular seal, and each of said spaces communicates with the aforementioned chamber. Means are provided by which the pressure increases in the chamber when the pin is inserted. The pressure rise in the spaces around the seals increases the pressure force of the seals against the pin. The efficiency of the seals in breaking the fluid films on the pin is thus reinforced by the very insertion of the pin.

The invention will be easily understood by reading the following description of a preferred embodiment, with reference to the drawings.

IN THE DRAWINGS

FIG. 1 shows the male portion of the connector assembly according to the invention.

Figure 2B:
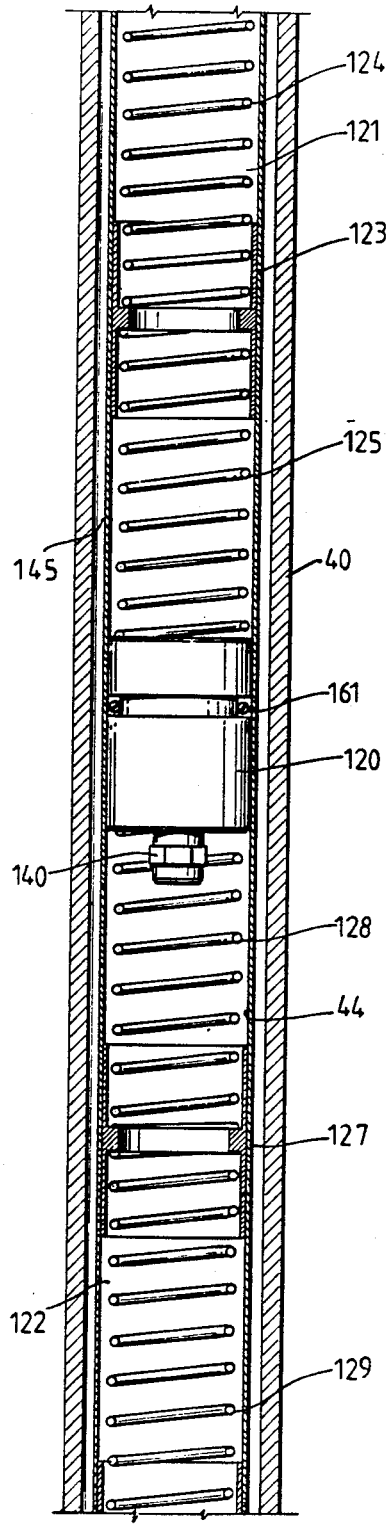
Figure 2C:
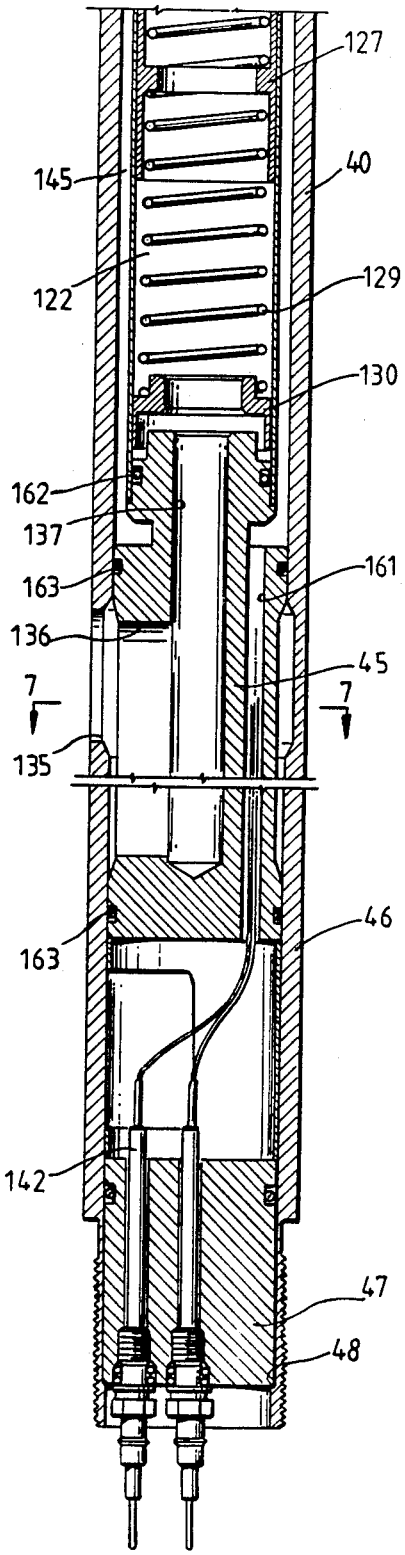
Figure 3:
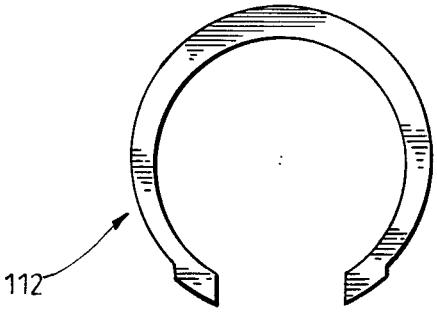
Figure 4:
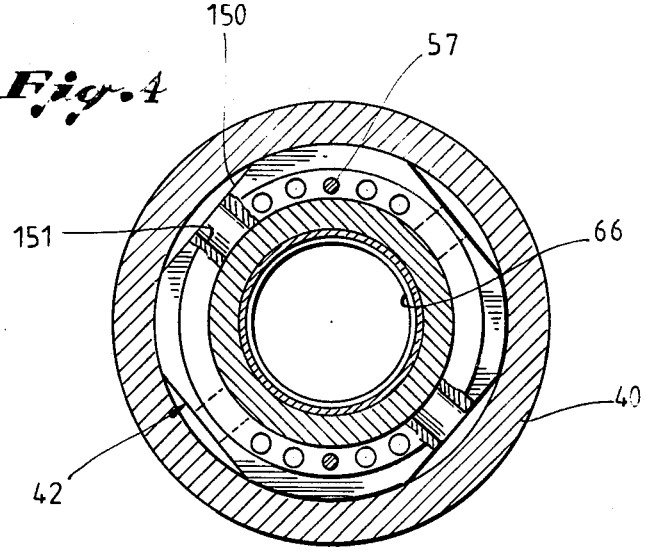
Figure 5:
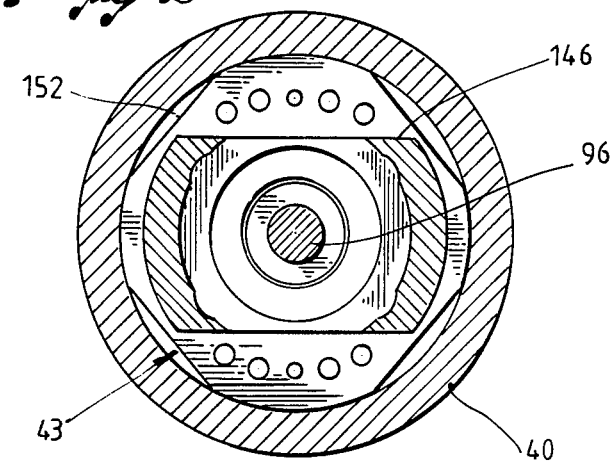
Figure 6:
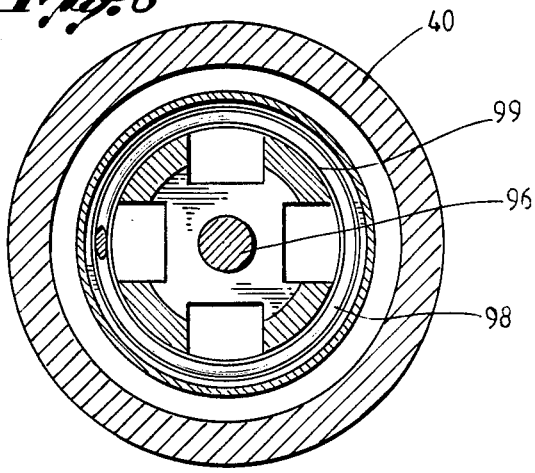
Figure 7:
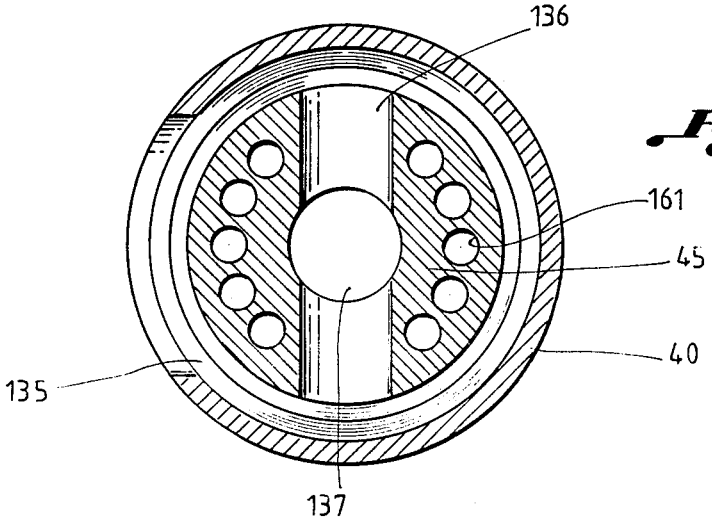

FIGS. 2A, 2A', 2B and 2C show a longitudinal cross-section of the female portion of the connector assembly according to the invention; FIGS. 2A and 2A' shows the front portion capable of accommodating the male portion, and FIGS. 2B and 2C show the rear portion, FIG. 3 is a detailed view of a snap ring mounted at the front end of the female connector, FIGS. 4, 5 and 6 are cross-sections along respectively lines 4—4, 5—5 and 6—6 of FIGS. 2A and 2A', FIG. 7 is a cross-section along line 7—7 of FIG. 2C, and FIG. 8 illustrates a way of making an electrical connection in a deviated borehole.

The male connector represented in FIG. 1 comprises an elongated cylindrical pin 10 with a series of axially spaced annular electrical contacts 11. The contacts 11 are insulated from each other by insulator blocks 12 of same diameter. Electrical conductors, not shown, are connected to the respective contacts 11. The pin can be constructed in any conventional manner. For instance, the pin may comprise a central rod supporting the contacts and the insulator blocks, and means such as coupling pins to hold the contacts and blocks in a proper angular position.

Conventional means, not shown, are provided at the rear end of the male connector for its connection with an equipment such as a transmission cable. At the front end of the male connector, there is a piece 16 including a part **16*a* having the same diameter as the insulator blocks 15 and extending in a "nose" 27 decreasing in diameter towards the front, with a maximum diameter smaller than that of part 16*a*. Near the radial shoulder 28 joining part 16*a* to the nose 27 is a peripheral groove 29 on the nose, the role of which will be explained below. In addition, a radial opening 30 goes through the nose at the level of the groove 29, and connects with an axial hole 31** which outlets at the forward end of the nose.

The female connector is represented in FIGS. 2A and 2A' (generally referred to as 2A), 2B and 2C, with an overlap between the figures to facilitate understanding.

The female connector has a tubular housing 40 extending throughout its length. Inside this housing 40 are placed in succession from front to back, a retainer 41, a series of annular insulator blocks 42, an intermediate sleeve 43 (FIG. 2A), a thin tube 44 (FIGS. 2A, 2B and 2C) attached to the sleeve 43 by a bayonet connection **44*a*, a rear bulkhead 45 fitted onto the tube 44, a spacer 46 and a connector piece 47 (FIG. 2C). The assembly comprised of these parts abuts against an internal shoulder 48 formed at the rear end of the housing 40 (FIG. 2C) and is held by a nut 49 screwed onto the forward end 50 of the housing 40**.

The portion represented in FIG. 2A which is intended to accommodate the pin 10 of the male connector comprises in particular retainer 41, insulator blocks 42 and the intermediate sleeve 43. The insulator blocks, made of insulating material, have stepped ends 55 so that two adjacent insulator blocks present complementary parts which fit one another.

As is clearly seen on the cross-section in FIG. 4, through-holes 56 for the passage of the conductors are formed parallel to the axis of the plug in each insulator block 42. In addition, blind holes 57, also longitudinally oriented, are formed in each insulator block on each side to accommodate pins for the angular positioning of each insulator block relative to the adjacent insulator block.

Between each pair of insulator blocks 42 is placed a contact 61 made of conductive metal. The contacts 61 comprise an internal cylindrical portion 62 and a central external collar 63 with a shoulder 64. The collar 63 is held between two insulator blocks 42 and has drilled holes in line with the holes 56 and 57 of the insulator block 42, to allow passage of an alignment pin and electrical conductors, which are shown only (partially) in FIG. 2C as 143 for clarity.

The set of internal surfaces of the contacts 61 defines a bore 65 with a diameter slightly larger than the external diameter of the pin 10 of the male connector. Of course, the spacing between the contacts 61 defined by the dimensions of the insulator block 42 is identical to the spacing between the contacts 11 of the male connector so as to allow simultaneous connection of the contacts 61 with the corresponding contacts 11.

Each contact 61 has on its inner surface a groove in which flexible tabs 66 are mounted. The tabs 66 project slightly into the interior of the bore 65 so as to ensure proper contact with the contacts 11 of the male connector.

Seals 70, generally tubular in shape, are placed between the contacts 61. Each seal 70 includes end parts 71, 72, with an external diameter substantially equal to the inside diameter of the insulator blocks 42, and a central portion 73 with a smaller diameter, which defines an annular space 74 between each seal 70 and the surrounding insulator block. Each of the end parts 71, 72 is held between the inner surface of an insulator block 42 and the outer surface of the cylindrical portion 62 of an adjacent contact 61, with the end surface of the seal abutted against the shoulder 64 of the contact 61. The central portion 73 presents internal corrugations 75, when seen in the axial direction. The inside diameter of part 73, taken at mid-height of the corrugations 75, is substantially identical to the diameter of the bore 65, so that the crest of the corrugations projects towards the inside of the bore 65.

The insulator block **42*a* adjacent to the retainer 41 is connected to the latter by pins fitted in blind holes. The retainer 41 has a rear portion shaped like an insulator block 42 to support, along with the adjacent insulator block 42*a*, the forwardmost contact 61 and seal 70**.

In like manner, the insulator block **42*f* located at the rear of the stack of insulator blocks, is connected to the intermediate sleeve 43 by pins, and as is shown in the cross-section in FIG. 5, the sleeve 43 has openings 58 aligned with the holes 56** in the insulator blocks for the passage of conductors.

The middle portion 80 of the retainer 41 has the same inside diameter at the contacts 61. Its forward portion 81 has a larger inside diameter to accommodate a seal 82, held between the middle portion 80 and washer 83 held by a circlip 84 inserted in a groove in the front portion 81. The seal 82 is made of a flexible piece with a radial wall 85 connecting an external axial wall 86 to an internal wall 87, which is urged radially inwardly by a circular resilient ring 88 held by the bent edge of the internal wall 87.

The bore 65 is filled with a dielectric liquid such as oil. It is sealed in the unconnected position of the female connector represented in FIG. 2A, by a shuttle composed in the present embodiment of a telescopic assembly. This assembly comprises a piston 90, the forward end of which forms a sealing member 91 having essentially the same outside diameter as the bore 65, and the rear portion of which is a tube 92 with a slightly smaller outside diameter, substantially equal to the diameter of the crest of the seals 70. A second piston 95, tubular in shape, is slidable inside tube 92. This second piston accommodates a rod 96, connected by a pin **96*a* to a third piston 97 with a generally tubular shape, which is slidably mounted in tube 44. A helicoidal spring 98 is mounted between an inside shoulder 99 formed on a tube 99*a* slidably mounted inside tube 44 and a collar 100 forming the front end of the third piston 97. The spring 98 acts to urge the piston 97 forward into contact with the rear face of the intermediate sleeve 43. Another spring 101 is mounted around the front portion 102 of the rod 96, which portion has a diameter smaller than the rest of the rod 96, between a thrust surface 103 at the front end of the second piston 95 and a bearing surface 104 joining the front portion 102 to the other part of the rod 96. Spring 101 acts to urge the second piston 95 forward. The front end of the second piston 95 has an axial opening 106** for fluid communication.

In addition, as is shown in the cross-section in FIG. 6, the third piston 97 has on its external surface a series of longitudinal notches 105. These notches are in communication with notches 106' formed inside the piston 97, which outlet in the space defined between the rod 96 and the collar 100. The bore 65 is thus connected to the space located behind the shuttle; through axial opening 106, around front portion 102 into notches 117 and therethrough to openings 153 and further through notches 106' and 105 to chamber 121.

The sealing member 91 presents a transverse wall 110 which closes the bore 65. Near its forward end, the sealing member 91 has an internal peripheral groove 111 in which is lodged a flexible C-ring 112, represented on the detailed view in FIG. 3. The ring 112 is shaped to engage the groove 29 provided at the end of the male connector during a connection, so as to couple the male connector to the sealing member 91 during the movement of the pin 10 inside the bore 65 of the female connector.

The tube 92 of the first piston 90 has diametrically opposed lateral notches 114 along a good portion of its length, in which a pin 115 attached to the front of the second piston 95, is engaged. In the position shown in FIG. 2A, the pin 115 abuts against the rear end wall of the notches 114, which holds the first piston 90 in the position indicated and prevents the sealing member 91 from moving forward from its sealing position.

In like manner, a pin 116 attached to the rod 96 connected to the third piston, is engaged in diametrically opposed notches 117 formed in the second piston 95. FIG. 2A shows pin 116 abutted against the rear end walls of the notches 117.

Looking at FIGS. 2B and 2C showing the rear portion of the female connector, one notes that inside of the tube 44 is placed a piston 120 which divides in a fluid-tight manner the inner spaces of the female connector, into two chambers 121 and 122. Chamber 121 receives the piston 97 and the tube **99*a* and is located in the extension of the bore 65; the fluid communication between chamber 121 and the bore 65 is, as indicated above, ensured by the notches 105 and 106 of the piston 97. Another tube 123 similar to tube 99***a*, equipped like the latter with an internal shoulder is slidably mounted inside tube 44. A spring 124 is mounted between the internal shoulders of the two tubes 99*a* and 123, and another spring 125 is placed between the piston 120 and the internal shoulder of the tube 123.

A similar arrangement is provided in chamber 122 behind the piston 120, where a tube 127 similar to the tube 123 is slidably mounted. A spring 128 resting on the inner shoulder of tube 127 acts on the piston 120, and a spring 129 acting on the inner counterbore of tube 127 rests on a stepped washer 130 welded inside the tube 44 near its rear end. The housing 40 has an opening 135 at the level of the bulkhead 45, and the latter, represented in cross-section in FIG. 7, has a lateral opening 136 opposite the opening 135 and an axial bore 137 in communication with opening 136, which in turn connects the chamber 122 to the outside. The chamber 122 thus serves as a pressure compensation bore, with the piston 120 transmitting the pressure of the external fluid to the oil present in chamber 121 and in bore 65. The pressure in chamber 121 is in fact greater than the pressure of the external fluid due to the action of the springs 128 and 129 on the piston 120. This pressure difference acts on the sealing member 91 to keep it in the sealing position shown in FIG. 2A. A pressure differential of the order of 2 bars or more, for example 2.5 bars, is sufficient. The springs 128 and 129 are much stronger than springs 124 and 125 placed on the opposite side of the piston 120.

The piston 120 has a relief valve 140 which acts to limit the pressure in the chamber 121 to a given value, e.g. between 7 and 10 bars.

The rear bulkhead 45 has holes 161 for the passage of the conductors, shown partially in FIG. 2C as 143, connecting the_contacts 61 to the electrical feedthroughs 142 mounted in the connection head 47. The connection with the electrical feedthroughs 142 occurs inside the inner space of spacer 46.

The passage of conductors from the holes 161 is supplied by the annular space 145 between the tube 44 and the housing 40, and by the spaces defined between the flats 146, better seen in FIG. 5, formed on the periphery of the intermediate sleeve 43, and the housing 40. The holes 58 formed in the front portion of the sleeve 43 outlet into the spaces 146. On FIG. 4, one also notes that the insulator blocks 42 have flats 150 on their periphery, and radially oriented openings 151, which connect for fluid communication the inside and outside of each insulator block 42. In like manner, the sleeve 43 has in its forward portion flats 152 aligned with the flats 150 of the insulator blocks 42, and a radial opening 153 (FIG. 2A) for fluid communication between the inside of the sleeve 43 and the space defined between the flats 146 and the housing 40.

This arrangement provides fluid communication between each of the chambers 121, the bore 65 which accommodates the shuttle, the inside of tube 44, the annular space defined between the tube 44 and the housing 40, the holes 58 and 56 for passage of conductors, the annular spaces 74 provided between the seals 70 and the respective insulator blocks 42, and in the rear portion, with openings 141 and the inner space of the spacer 46. Tightness is ensured by the seal 82 in the front of the bore 65 and by the O-ring 160 mounted on the outside of the retainer 41, by the O-ring 161 mounted on the compensation piston 120, by the O-ring 162 mounted on the front end of the rear bulkhead 45 to ensure a fluid-tight connection with the tube 44, by the seals 163 mounted on the head 45 to separate the outlet passages of the bulkhead 45 from the space surrounding the tube 44 and from the openings 141, and by the connector head 47.

FIG. 8 illustrates, in a non-limiting manner, an example of utilization and a suitable technique for bringing into engagement the male connector and the female connector in a highly deviated borehole. Such a technique is described in copending patent application No. 460,340 filed Jan. 24, 1983, now U.S. Pat. No. 4,485,870 assigned to the assignee of the present application, and which is incorporated herein by reference.

The female connector is shown as reference numeral 200 in FIG. 8, the only portion shown being its forward end. The female connector is connected to a logging tool 201 releasably secured at the bottom end of a drill pipe 202. The female connector is mounted inside the bottom end of a stinger tubing 203 disposed inside the drill pipe 202 and secured to the logging tool 201.

The male connector 205 is suspended from the transmission cable 206 which it is intended to connect to the logging tool 201. A dual locomotive device including an outer locomotive 207 and an inner locomotive 208 is used to pump down the male connector into engagement with the female connector 200. In a first step of the descent the two locomotives form a unit with the male connector, which unit is pumped down through the drill pipe by the action of the outer locomotive 207. It is to be noted that instead of this arrangement, the male connector can be attached to the logging tool and the female connector suspended from the cable. The following description would remain true except that the movable part, connected to the locomotive, would be the female connector and not the male connector.

When the latter engages the upper end of the stringer tubing 203, the continuing pumping brings about the separation of the locomotives. The inner locomotive together with the male connector is pumped down further through the stinger tubing. It should be noted that the stinger tubing 203 has an inwardly projecting portion 209 forming on one side an abutment surface engaged by the other side in abutment surface intended for engagement by the male connector and thus defining the final connection position of the male connector. Nevertheless, other means can be used to define the final position of the male connector, for instance there could be provided abutment surfaces respectively on the male and the female connector, which surfaces would engage each other directly.

The operation of the connector assembly will now be described in detail.

When the male connector is brought into contact with the female connector, the nose 27 of the pin 10 enters the opening of the sealing member 91 until the shoulder 28 at the front of the pin engages the annular end surface of the sealing member 91. Just before the contact occurs, the snap ring 112 engages in the groove 29 formed on the nose of the pin 10. As the nose 27 moves into the sealing member, the fluid, i.e. the drilling mud in the above described situation, present in the cavity of the sealing member is expelled through the axial hole 31 and the radial hole 30.

Continued movement of the male connector pushes the sealing member 91 and thus the piston 90 towards the inside (to the rear, per the foregoing definitions) against the action of the oil pressure in the bore 65. The pin 10 replaces the sealing member 91 in the cooperation with the seal 82 to maintain the tightness of the bore 65 from the external fluid. In the first phase, only the piston 90 moves back. When the pin 115 of the second piston 95 comes into contact with the front end of the notches 114, the second piston 95 is also moved back against the action of the spring 101. Then, when pin 116 connected to the third piston 97 reaches the front end of the notches 117, the third piston is in turn pushed back against the action of the spring 98. Springs 124 and 125 are then compressed until tubes 99*a* and 123 are abutted.

In addition, the insertion of the pin 10 into the bore 65 expels the oil out of the latter and moves the piston 120 back since the volume of the oil bore must remain essentially constant. The springs 128, 129 are further compressed by this piston movement and thus the force exerted on the piston 120 by the springs is substantially increased and with it the pressure of the oil in chamber 121.

The rise in the oil pressure, especially in the annular spaces 74 surrounding the seals 70 results in a considerable increase in the contact pressure exerted by the seals 70 on the pin 10. Due to this reinforced action of the seals 70, any films of drilling mud remaining on the pin 10 are broken thus eliminating the risk of short-circuits between adjacent contacts due to the presence of such films (as drilling fluid is generally a conductor). The relief valve 140 installed in the piston 120 prevents the establishment of an excessive pressure at this point.

The insertion movement of the male connector ends when the latter comes into contact with the projecting portion 209 of the stinger tubing. In this relative position of the male and female connectors, the contacts 11 and 61 are exactly opposite one another and the electrical connection is made.

At this point, a logging operation can be carried out, in accordance with the technique described in U.S. Pat. Nos. 4,349,072 or 4,485,810. The logging tool 201 is released and the stinger tubing together with the logging tool is pumped out of the drill pipe, until the upper end of the stinger tubing engages a stop on the drill pipe. Then the ensemble is returned to its initial position inside the drill pipe by pulling on the transmission cable, and the logging measurements are produced during that return motion.

To disconnect, the male connector is withdrawn from the bore 65 by pulling on the cable. During withdrawal, the oil pressure in chamber 121 gradually decreases. The sealing member 91 is forced to follow the male connector because of the pressure differential and of their mutual coupling created by the engagement of the snap ring 112 in the groove 29. This elminates any risk of a gap between them during withdrawal. If such a gap was allowed to occur, the resulting free space would be occupied by the oil and thus a certain quantity of oil would escape when the male connector is fully withdrawn.

Continued movement of the withdrawing male connector returns the shuttle to the position shown in FIG. 2A, according to a process inverse of that initiated by the insertion of the pin 10. When the sealing member 91 has reached its end position, defined by the abutting of pin 115 against the end of the notches 114, the withdrawal of the male connector causes the disengagement of the snap ring 112 from the groove 29, thus freeing the male connector.

It should further be noted that with the device described, the assembly of the female connector is simplified. First the front portion including retainer 41, insulator blocks 42 and the intermediate sleeve 43, contacts 61 and seals 70 is preassembled, and the conductors are threaded through the appropriate holes. The rear portion is also pre-assembled, i.e. essentially the tube 44 and the elements it accommodates, the washer 130 secured to the tube serving as a retainer against the springs. The telescopic shuttle is inserted in the bore 65 defined by the front portion, and then the tube 44 is attached to the sleeve 43 by means of the bayonet connection 44*a*. The electrical conductors can be taped or otherwise attached to the outer surface of the tube 44. They are passed through the openings 161 in the head 45, the forward end of which has first been inserted into the tube 44, and they are attached to the electrical feedthroughs 142, for which purpose the spacer 46 is provided with a side opening. The sub-assembly thus formed is inserted inside the housing 40 until the head 47 comes into contact with the shoulder 48 at the rear end of the housing 40, and the nut 49 is then screwed onto its foward end.

A cylindrical fill pin with the same shape and size as the pin 10 of the male connector and which has an axial passage outletting to its forward end, is used to fill the chamber 121. This pin is inserted in the female connector to push the shuttle and the piston 120 back into their respective connection position. At this point, the axial passage is connected to a vacuum pump to evacuate the air from the female connector, then to an oil pump. The oil is pumped into the female connector until the pressure reaches the set point of relief valve 140. Pumping is then stopped and the fill pin is removed. The shuttle and the piston 120 return to their position shown in FIG. 2A, and since the springs 128, 129 are less compressed, the oil pressure falls to a relative value of about 2.5 bars, sufficient, however, to keep the sealing member 91 firmly in the sealing position represented in FIG. 2A.

Further modifications will also occur to those skilled in the art, and such are considered to fall within the spirit and scope of the invention as defined in the appended claims.

We claim:

1. A connector assembly for effecting the connection of a plurality of electrical conductors in a fluid medium comprising:

a male connector having an elongated pin member extending along the longitudinal axis of said male connector and terminating with a free distal end, first electrical contacts arranged at longitudinally-spaced intervals along said pin member, and first electrical insulators cooperatively arranged on said pin member for electrically isolating said first electrical contacts from said pin member and one another;

a female connector having a housing with an open end portion for receiving said elongated pin member upon movement of said connectors into coupling engagement, second electrical contacts respectively arranged at longitudinally-spaced intervals in said housing for cooperatively engaging said first electrical contacts upon coupling engagement of said connectors, and second electrical insulators cooperatively arranged within said housing for electrically insulating each of said second electrical contacts from said housing and one another; and means on said female connector operable upon movement of said connectors into coupling engagement for fluidly isolating said second electrical contacts including a plurality of tubular sealing elements coaxially disposed at longitudinally-spaced intervals within said housing and alternately arranged therein between said second electrical contacts for defining a fluid-tight annular space within said housing around said sealing elements and an axial bore within said sealing elements for receiving said pin member, an actuating member coaxially arranged within said housing for moving longitudinally through said axial bore between an extended position where one end of said actuating member is disposed on one side of said second electrical contacts and a telescoped position where said one end of said actuating member is disposed further within said housing on the other side of said second electrical contacts, means arranged on said one end of said actuating member for engaging said distal end of said pin member so that once said connectors have moved into coupling engagement, said actuating member will be moved from its said extended position to its said telescoped position, and means operable upon movement of said actuating member from its said extended position to its said telescoped position for supplying a pressured fluid to said fluid-tight annular space to constrict said sealing elements around said pin member for wiping said pin member and said first electrical contacts as said connectors are moved into coupling engagement.

2. The connector assembly of claim 1 further including means defining an enclosed fluid chamber within said housing and said axial bore of said sealing elements for retaining a dielectric fluid around said first electrical contacts and including a fluid seal coaxially mounted in said open end portion of said housing and cooperatively arranged for sealingly engaging said actuating member when it is in its said extended position and for sealingly engaging said pin member as it enters said housing as said connectors are moved into coupling engagement.

3. The connector assembly of claim 1 wherein said means for supplying a pressured fluid to said fluid-tight annular space include an enclosed fluid chamber within said housing, passage means communicating said fluid-tight annular space and said enclosed fluid chamber, a piston cooperatively arranged in said enclosed fluid chamber for movement from a first position toward a second position for displacing a pressured fluid from said fluid chamber into said fluid-tight annular space around said sealing elements, and means operable upon movement of said actuating member toward its said telescoped position for moving said piston toward its said second position as said connectors are moved into coupling engagement.

4. The connector assembly of claim 3 further including:

means for enclosing said axial bore of said sealing elements to retain a dielectric fluid around said first electrical contacts including a fluid seal coaxially mounted in said open end portion of said housing for sealingly engaging said actuating member when it is in its said extended position as well as for sealingly engaging said pin member as it moves said actuating member toward its said telescoped position when said connectors are moved into coupling engagement; and means cooperatively arranged for maintaining the pressure of a dielectric fluid in said axial bore at a level greater than the pressure of a fluid medium outside of said housing.

5. The connector assembly of claim 1 wherein said means for supplying a pressured fluid to said fluid-tight annular space include:

means defining an enclosed fluid chamber within said housing and said axial bore of said sealing elements for retaining a dielectric fluid around said first electrical contacts including a fluid seal coaxially mounted in said open end portion of said housing and cooperatively arranged for sealingly engaging said actuating member when it is in its said extended position and for sealingly engaging said pin member before it enters said axial bore of said sealing elements as said connectors are moved into coupling engagement;

passage means between said fluid-tight annular space and said enclosed fluid chamber;

a piston cooperatively arranged in said enclosed fluid chamber for movement from a first position toward a second position for displacing a pressure fluid in said fluid chamber through said passage means into said fluid-tight annular space around said sealing elements; and means operable upon movement of said actuating member toward its said telescoped position for moving said piston toward its said second position as said connectors are moved into coupling engagement.

6. The connector assembly of claim 5 further including means cooperatively arranged within said housing for maintaining the pressure of a dielectric fluid in said fluid chamber at a level greater than the pressure of a fluid medium outside of said housing.

7. The connector assembly of 5 wherein each of said tubular sealing elements include a flexible central portion having longitudinally-spaced inwardly-directed corrugations which are normally engaged with the external surface of said actuating member when said actuating member is in its extended position.

8. A connector assembly for effecting the connection of a plurality of electrical conductors in a fluid medium comprising:

a male connector arranged around a central longitudinal axis and having an elongated member extending along said central axis of said male connector and terminating with a free distal end portion, a plurality of first electrical contacts disposed at longitudinally-spaced intervals along an intermediate portion of said elongated member, and first insulator means for electrically isolating said first electrical contacts from said elongated member and one another;

a female connector having a tubular body arranged around a central longitudinal axis and having an open end body portion for receiving said elongated member when said connectors are moved into coupling engagement with one another and an intermediate body portion defining an enclosed fluid chamber, a plurality of second electrical contacts disposed at longitudinally-spaced intervals in said body between said body portions are arranged for respectively engaging said first electrical contacts when said connectors are moved into coupling engagement with one another, and second insulator means for electrically isolating said second electrical contacts from said body and one another;

means operable upon movement of said connectors into coupling engagement with one another for fluidly isolating said electrical contacts including a plurality of tubular sealing elements coaxially disposed within said body and alternately arranged on opposite sides of said second electrical contacts for defining a fluid-tight annular space within said body around the exterior of said sealing elements and an axial bore extending through the interior of said sealing elements for receiving said elongated member as well as for communicating said open end body portion with said enclosed fluid chamber, an actuating member coaxially arranged within said body for moving along said central axis of said body between an extended position where one end of said actuating member is disposed on one side of said second electrical contacts and a telescoped position where said one end of said actuating member is disposed further within said body on the other side of said second electrical contacts, means arranged on said one end of said actuating member for engaging said distal end of said elongated member so that once said connectors have moved into coupling engagement with one another said actuating member will be moved from its said extended position to its said telescoped position, and means for retaining a dielectric fluid around said first electrical contacts including an annular seal coaxially mounted in said open end portion of said body for sealingly engaging said actuating member when it is in its said extended position and for sealingly engaging said pin member before it enters said axial bore of said sealing elements as said connectors are moved into coupling engagement with one another;

a fluid passage communicating said enclosed fluid chamber with said fluid-tight annular space around said sealing elements;

a piston cooperatively arranged in said enclosed fluid chamber for movement from a first position toward a second position for displacing a dielectric fluid disposed in said enclosed fluid chamber through said fluid passage into said fluid-tight annular space around said sealing elements to constrict said sealing elements around said pin member as it enters said axial bore of said sealing elements; and means operable upon movement of said actuating member toward its said telescoped position for moving said piston toward its said second position as said connectors are moved into coupling engagement with one another.

9. The connector assembly of claim 8 further including pressure compensating means cooperatively arranged within said body for maintaining the pressure of a dielectric fluid disposed in said enclosed fluid chamber at a level greater than the pressure of a fluid medium outside of said body.

10. The connector assembly of claim 8 wherein each of said tubular sealing elements include a flexible central portion having longitudinally-spaced inwardly-directed corrugations which are normally engaged with the external surface of said actuating member when said actuating member is in its extended position.

11. The connector assembly of claim 10 further including a fluid passage in said body between the exterior of said body and said enclosed fluid chamber, a second piston cooperatively arranged in said enclosed fluid chamber between said fluid passage and the other piston, and biasing means urging said second piston toward said other piston for maintaining the pressure of a dielectric fluid disposed in said enclosed fluid chamber at a level greater than the pressure of a fluid medium outside of said body.

* * * * *